US009752857B1

(12) United States Patent
Mehta et al.

(10) Patent No.: US 9,752,857 B1
(45) Date of Patent: Sep. 5, 2017

(54) ELECTRIC DETONATOR WITH MILLED AND UNMILLED DBX-1

(71) Applicant: The United States of America as Represented by the Secretary of the Army, Washington, DC (US)

(72) Inventors: Neha Mehta, Succasunna, NJ (US); Gartung Cheng, Edison, NJ (US); Kin Yee, Rahway, NJ (US); Karl Oyler, New York, NY (US); Akash Shah, Clifton, NJ (US); John Marin, Roseto, PA (US); John W. Fronabarger, Sun Lakes, AZ (US); Michael D. Williams, Gilbert, AZ (US); Steven H. Marino, Gap, PA (US); Pamela Tran, Shillington, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/015,460

(22) Filed: Feb. 4, 2016

Related U.S. Application Data

(60) Provisional application No. 62/192,262, filed on Jul. 14, 2015.

(51) Int. Cl.
*F42B 3/12* (2006.01)

(52) U.S. Cl.
CPC ..... *F42B 3/124* (2013.01)

(58) Field of Classification Search
CPC ..... F42B 3/10; F42B 3/12; F42B 3/13; C06B 31/00; C06B 31/12; C06B 31/22; C06B 25/00; C06B 25/04
USPC ..... 102/202.5, 202.7, 202.11, 202.13, 275.9, 102/275.11, 200, 293, 283, 292; 149/88, 149/94, 96, 99, 105, 111, 110
See application file for complete search history.

(56) References Cited

U.S. PATENT DOCUMENTS

| | | | | |
|---|---|---|---|---|
| 3,340,808 | A * | 9/1967 | Leopold | C06B 35/00 102/202.14 |
| 8,062,443 | B2 | 11/2011 | Fronabarger | |
| 2012/0024178 | A1 * | 2/2012 | Fronabarger | F42B 3/124 102/202.7 |

* cited by examiner

*Primary Examiner* — Jonathan C Weber
(74) *Attorney, Agent, or Firm* — Lisa H. Wang

(57) ABSTRACT

Lead free microdet electric detonators comprising a bridgewire having milled DBX-1 as a spot charge and unmilled DBX-1 as the intermediate material. Such improved microdet electric detonator is free of lead azide and lead styphnate, but with comparable stability, power and sensitivity to current lead-based M100 electric detonators.

15 Claims, 3 Drawing Sheets

ELECTRIC DETONATOR WITH MILLED AND UNMILLED DBX-1

RELATED APPLICATIONS

This application claims the benefit of provisional application No. 62/192,262 filed Jul. 14, 2015, which is incorporated herein by reference in its entirety.

STATEMENT OF GOVERNMENT INTEREST

The inventions described herein may be manufactured, used and licensed by or for the United States Government without payment of any royalties thereon or therefore.

BACKGROUND OF THE INVENTION

The invention relates to improved electric detonators comprising lead-free compositions having the same functionality as the standard lead-based detonators.

Detonators are tiny compact devices that are used where a strong shockwave is needed to initiate larger explosive charges, such as leads or boosters (secondary explosives) via sympathetic detonation; their applications range from explosive munitions to demolition charges. They are frequently incorporated as parts of a larger fuze apparatus which may also include additional pyrotechnic delays and/or booster charges. As such, detonators are essential for a huge number of explosive munitions including grenades, mortars, rockets, artillery rounds, submunitions, etc. The two main types of detonators are stab and electric. Stab detonators (FIG. 1), are initiated by a mechanical force whereas electric detonators (FIG. 2) are initiated by an electrical impulse which causes resistive heating in an embedded metal bridgewire.

A small scale electric detonator is called a "microdet". One example of a microdet detonator is the M100. Current microdets detonators, such as the M100, are similar to hot wire initiators, where a metal bridgewire is covered with a lead styphnate spot charge. An electrical current heats the bridgewire by voltage that is applied via a firing circuit which ignites the spot charge, lead styphnate (LS) to initiate the ignition material, lead azide (LA), which in turn initiates the output charge, HMX. This detonator is used in all military mortar fuzes such as M734, M759, etc. to further set off the lead to the booster to the main charge explosives. Standard military M100 electric detonators must meet stringent requirements of having an output dent greater than or equal to 0.005". Typical output dents generated by current electric M100 electric detonators containing lead azide and lead styphnate compositions are between 0.010" to 0.016" with all fire parameters of 1.6V at 100 μF capacitor.

Current microdet electric detonators such as M100 contain lead azide and lead styphnate which are toxic. Furthermore, lead azide reacts with copper, zinc or alloys containing such metals, forming other azides that can be highly sensitive and dangerous to handle. In addition, lead-based materials are well established to cause environmental and health related problems. Lead-based materials are cataloged on the EPA Toxic Chemical List (EPA List of 17 Toxic Chemicals); they are additionally regulated under the Clean Air Act as Title II Hazardous Air Pollutants, as well as classified as toxic pollutants under the Clean Water Act, and are on the Superfund list of hazardous substances. Recently, under the Clean Air Act, USEPA (U.S. Environmental Protection Agency) revised the National Ambient Air Quality Standard (NAAQS) to 0.15 $\mu g/m^3$, which is ten times more stringent than the previous standard. Lead is both an acute and chronic toxin, and the human body has difficulty in removing it once it has been absorbed and dissolved in the blood. Consequently, a chief concern is the absorption of lead by humans from exposure to initiating mix constituents, as well as the combustion by-products of lead based compositions. The health effects of lead are well documented; however, recent studies have shown that there are no safe exposure levels for lead, in particular for children. There is a direct correlation between lead exposure and developmental impacts, including IQ loss (even at the revised lead NAAQS, exposure levels are consistent with an IQ loss of over 2 points), behavioral issues and even hearing loss. Their use during military training and testing deposits heavy metals on munition ranges and can impact sustainable use of these ranges. Manufacturing of any lead-based primary explosives, such as lead azide or lead styphnate, results in the production of significant quantities of highly toxic hazardous waste. Handling and storage of these compounds is also a concern. Thus, a need exists for effective microdet electric detonators that are free of lead components yet produce the same rigorous performance qualities as the standard lead-based detonators.

SUMMARY OF INVENTION

The present invention replaces lead-based products in military detonators with non-toxic energetics that achieves, at a minimum, equal to or better output performance than the standard lead-based product.

It is thus an object of the present invention to replace detonators containing lead azide and lead styphnate with milled DBX-1 as the spot charge and unmilled DBX-1 as an intermediate charge without losing any of the functionality associated with the current lead-based detonators. The present inventive lead-free detonators must meet the rigorous performance standards of having an output dent of greater than or equal to 0.005" under firing parameters of 1.6V at 100 μF capacitor.

In one embodiment of the present invention, a microdet electric detonator is disclosed comprising milled DBX-1 as the spot charge on the metal bridgewire and unmilled DBX-1 as the intermediate charge material. The particle size of the milled DBX-1 is about 1 μm to about 28 μm, preferably about 3 μm to about 12 μm and more preferably about 5 μm to about 11 μm.

In another embodiment of the present invention, the unmilled DBX-1 is loaded at a reduced consolidation pressure of about 8 Kpsi to about 10 Kpsi and the output charge, HMX weight and loading column height is reduced compared to standard lead-based products. The HMX is loaded at about 12 mg, at a consolidation pressure of about 12 Kpsi to about 14 Kpsi, and about 0.100" to about 0.130" in height.

The nature of the subject invention will be more clearly understood by reference to the following drawings, detailed description, and the appended claims.

BRIEF DESCRIPTION OF THE DRAWINGS

Further features and advantages of the present invention may be understood from the drawings.

DETAILED DESCRIPTION

A typical electric detonator is composed of three main components: a bridgewire, an intermediate charge and an output explosive charge. The bridgewire acts to transmit electrical impulses to the intermediate charge creating a cascade of subsequent chemical reactions to detonate the main explosive. Both LA and LS have been widely adopted by the military as the two most common primary explosives acting in concert to detonate the main explosive charge. For many measurable explosive properties, LA and LS behave similarly, possessing comparable sensitivity to impact and friction, detonation velocity, thermal stability, and power (as determined by Trauzl Pb block tests). Where they differ is in brisance, or shattering capability, with LA measured to be 39% TNT and LS found to only be 27% TNT. At least partially as a result, LA possesses much higher "initiating efficiency" for triggering secondary explosives such as RDX, HMX, and TNT; whereas LS is generally not capable of directly initiating secondary explosives with the exception of uncompressed PETN; instead, it is largely only capable of initiating other primary explosives or propellants. Further, LS tends to be much more sensitive to electrostatic discharge and to initiation by heat/flame. These qualities help to make LS much more reliable to initiate an intermediate explosive.

As a result of these key differences, LA and LS tend to be used for different initiation applications. Because of its much greater brisance and initiating efficiency, LA is the main explosive used in detonators and blasting caps acting as the intermediate charge to directly initiate secondary explosives. Whereas LS, with its higher sensitivity/reliability, fills the role of receiving the triggering stimulus (e.g. hot-wire or firing pin impact) and subsequently triggering another primary explosive, such as LA, or a propellant. Therefore, in general, many detonators require both LA and LS acting in concert to function properly as the triggering explosive and intermediate explosive; LA gives the ability to initiate secondary explosives, while LS gives the ability to initiate LA reliably.

Figure 1:
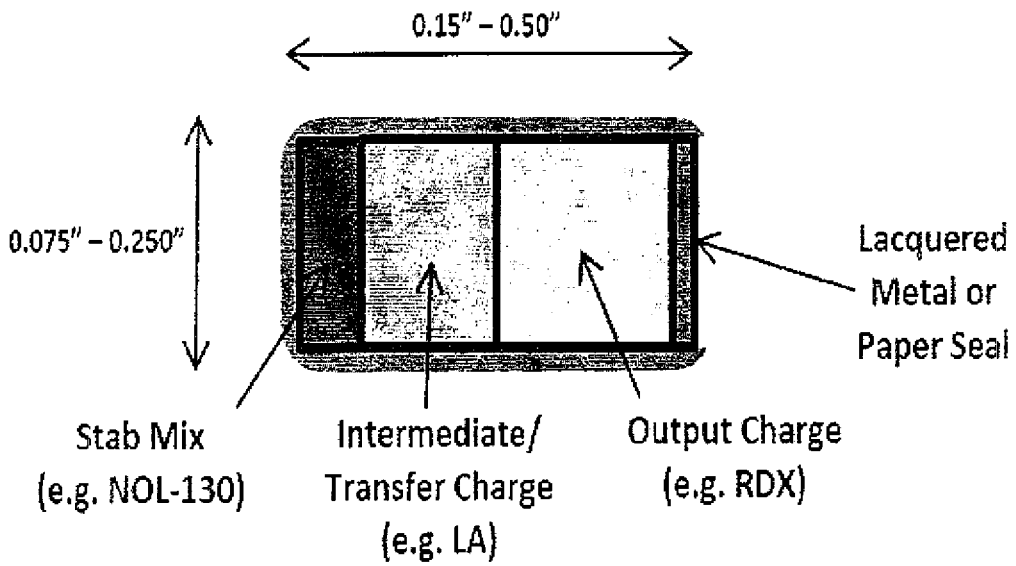
FIG. 1 is a representative standard stab detonator
Figure 2:
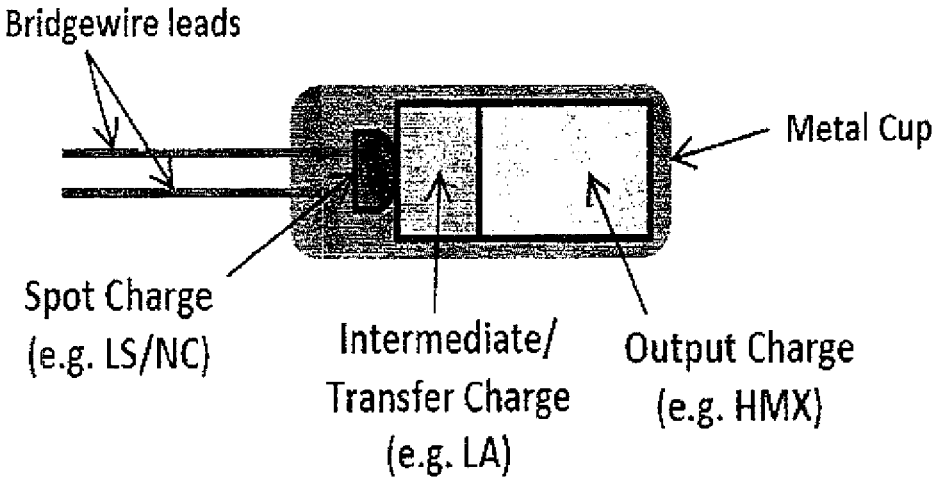
FIG. 2 is a representative standard microdet electric detonator
Figure 3:
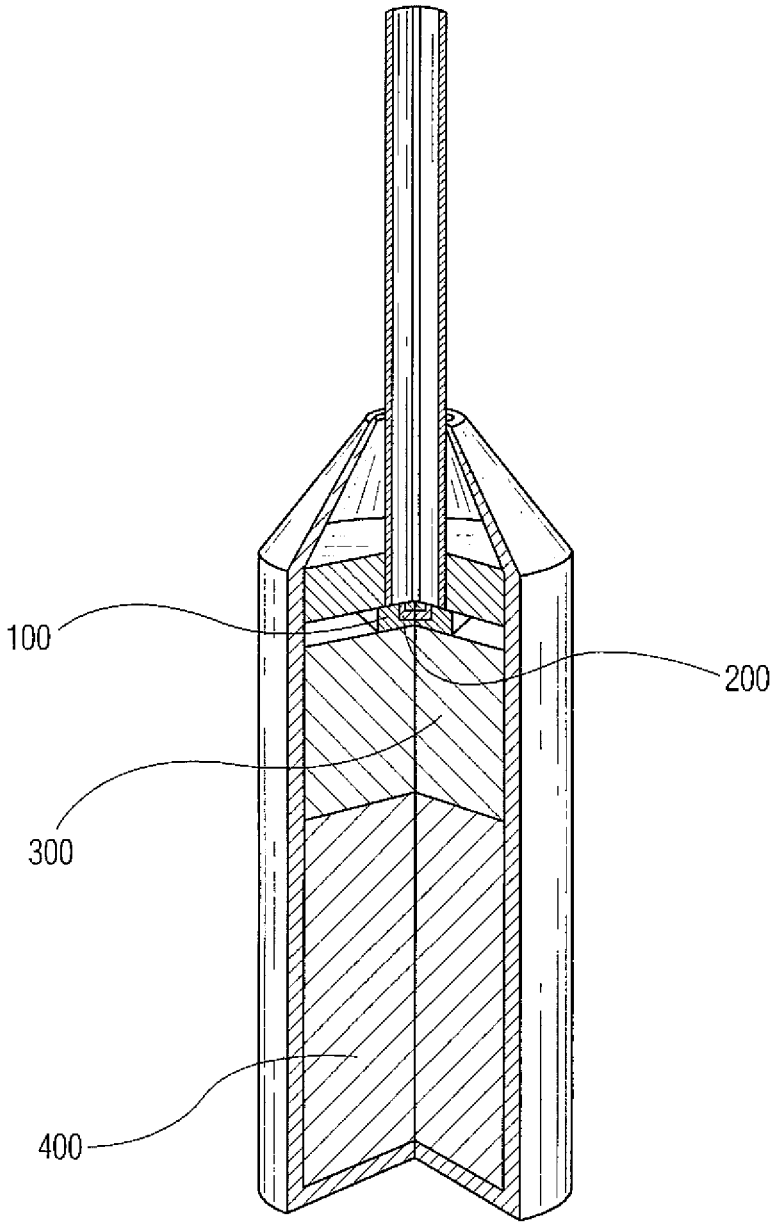
FIG. 3 is a representative standard M100 military electric detonator

In the M100 detonator (FIG. 3), the LS is typically applied as a spot charge on the bridgewire 200. LS 100 is initiated when the wire is electrically heated, which in turn initiates the LA 300 intermediate charge, which subsequently initiates the HMX output charge 400. The LS works well in the M100 because it has a very low hot wire ignition point. LA is not used as a spot charge because its hot wire ignition point is too high and fails to produce satisfactory results under normal firing energy pulses.

U.S. Pat. No. 7,833,330 to Fronabarger et al, discloses the use of copper (I) nitrotetrazolate (DBX-1) as a potentially useful lead free substitute for lead azide. DBX-1 has properties similar to lead azide such as friction sensitivity, impact sensitivity, and strong confinement/dent block testing. Accordingly, it has also been reported that the physical and chemical characteristics of DBX-1 would make it an ideal candidate as a drop-in replacement for LA. Conversely, DBX-1 would not be considered interchangeable with LS because its initiation and explosive properties is significantly different from LS. Consequently, it was presumed that DBX-1 has too high an ignition point and would therefore fail as an initiating explosive.

Table 1 below summarizes the differences between LA, LS and DBX-1

TABLE 1

| Lead Styphnate (normal) | Lead Azide | DBX-1 |
|---|---|---|
| Poor explosive initiating efficiency (only adequate for other primary explosives and PETN) | Good explosive initiating efficiency (can initiate most secondary explosives: RDX, HMX, etc.); | Comparable initiating efficiency to LA (can initiate secondary explosives such as RDX, HMX, etc.) |
| Most abundant primary explosive component found in primers (e.g. percussion primers for small arms) | Most abundant primary explosive component found in detonators and blasting caps | Prior reports investigate DBX-1 as LA replacement, not LS |
| Generally employed in mixtures with other ingredients (e.g. primer formulations, NOL-130 stab mix) | Generally employed as a neat material (notable exception: formulation ingredient in NOL-130 stab mix) | Employed as a neat material |
| High sensitivity to flame (2 ms to reach 100% probability of initiation) | Relatively low sensitivity to flame (11 ms to reach 100% probability of initiation)[4] | Flame test data not available |

Given that DBX-1 would not be a replacement for LS, it has unexpectedly been discovered that electrical detonators comprising the combination of milled DBX-1 as a spot charge and unmilled DBX-1 as an intermediate charge, and HMX results in comparable function and output over current detonators, but without the toxic lead-based products found in current electrical detonators.

The present milled DBX-1 composition is prepared by mixing milled DBX-1 into a slurry comprising of nitrocellulose lacquer, binder, carrier and solvent. The various components are all commercially available. Milled DBX-1 can be obtained from Pacific Scientific Energetic Materials Company (PSEMC). Preferably, the particle size of the milled DBX-1 is about 1 μm to about 28 μm, more preferably about 3 μm to about 12 μm and even more preferably about 5 μm to about 11 μm.

The milled DBX-1 slurry composition may be applied to the header of a metal bridgewire using techniques well known in the art. The slurry containing milled DBX-1 may be placed onto a bridgewire as a single spot. The amount of the milled DBX-1 can be applied in the range of about 0.27 mg to about 0.38 mg per header.

Typical bridgewire materials contemplated by the present invention are composed of metal. Preferred metals are nickel-chrome, platinum, tungsten, and platinum-irridium. Typical diameters of the bridgewire may be about 0.0005" to about 0.0002", preferably 0.00023".

The dimensions of the microdet electric detonators useful for the present invention have an outer diameter of 0.100" with an inner diameter of 0.075", an explosive column height of about 0.250", which includes the header and an explosive column length of about 0.190".

Example 1

An M100 microdet detonator comprising milled DBX-1 as the initiating charge, unmilled DBX-1 as the intermediate charge, and HMX as the output charge was prepared having a nickel-chrome bridgewire with a diameter of 0.00023". For the initiating charge, about 11 μm milled DBX-1 slurry composition was applied as a single spot charge to the bridgewire. The milled DBX-1 slurry composition comprises of a mixed ratio of clear lacquer adjusted to yield a 3.5% lacquer solids content depending on the amount of DBX-1 to be mixed into slurry and the percent of solids in the clear lacquer. The composition of clear lacquer comprises: camphor 9.8%, nitrocellulose (½ second) 26.2%, nitrocellulose (60 to 80 second) 14%, n-amyl alcohol 12.4%, and butyl acetate 37.6%. In one embodiment, 0.5 g milled DBX-1 (5 um) Lot# EL4X104B, 3.5% solids, and 0.15 cc lacquer were mixed together. Lacquer thinner (n-amyl alcohol 75% and toluene 25%) may be added for consistency. In another embodiment, 0.78 g milled DBX-1 (5 um) Lot# EL4X104B, was mixed with 3.4% solids and 0.22 cc lacquer. Lacquer thinner may be further added for consistency.

Lead-based standard detonators and lead-free detonator compositions of the present invention were loaded into M100 detonators as follows. The maximum column height for an M100 detonator is generally about 0.190". Thus, the standard loading parameters for HMX is about 15 mg, about 0.150" to about 0.160" column height and a consolidation pressure of about 12 Kpsi to about 14 Kpsi (Test number 1). The lead azide intermediate charge in the typical lead based M100 detonator is loaded at about 0.030" to about 0.040" column height and about 12 Kpsi to about 14 Kpsi (Test number 1). In contrast, the lead free detonators of the present invention can be loaded with less HMX at about 12 mg and about 0.100" to about 0.130" column height and under the same consolidation pressure as the standard lead-based HMX compositions (Test number 6 and 7 compared to Test number 1). The unmilled DBX-1 can be loaded at about 0.060" to about 0.090" column height with less consolidation pressure at about 8 Kpsi to about 10 Kpsi (Test number 6 and 7). The spot charge for each composition is applied according to Table 2.

A witness plate dent test was used to determine whether the lead free detonators of the present invention performed under high order or low order when fired at 1.6V at 100 μF. If the dent is 0.005" or higher, the charge is assumed to have gone "high order" meaning that the output charge in the detonator is functioning at or near its maximum detonation velocity. If the dent is less than 0.005" then it is a "low order" failure meaning the tested charge does not fully detonate and/or detonates at a much lower velocity.

Table 2 compares the results of the present inventive lead free detonator composition as described in Example 1 against detonators with LS or LA compositions fired at 1.6V at 100 μF capacitor.

TABLE 2

| Test Number | Spot Charge Charge Weight (g) | Intermediate Weight (g) Consol. P (kpsi) Height (inches) | HMX Consol. P (kpsi) Height (inches) | Results Average Dent (inches) | Performance |
|---|---|---|---|---|---|
| 1 | Lead Styphnate | Lead Azide 10 mg 14 Kpsi Height: 0.030" | 15 mg 14 Kpsi 0.160" | 0.010"-0.016" | High Order |
| 2 | Lead Styphnate | Unmilled DBX-1 Varied Varied | Varied Varied | Poor | Low Order |
| 3 | 2X Lead Styphnate | Unmilled DBX-1 8 mg 8 Kpsi 0.056" ± 0.002" | 16 mg 12 Kpsi 0.133" ± 0.002" | Poor | 7/14 High Order 6/14 Low Order-no dent 1/14-untested |
| 4 | Colloidal Lead Azide | Unmilled DBX-1 8 mg 8 Kpsi 0.056 ± 0.002" | 16 mg 12 Kpsi 0.133" ± 0.002" | Poor | Low Order |
| 5 | Lead Styphnate | Milled DBX-1 8 Kpsi 0.056 ± 0.002" | 16 mg 12 Kpsi 0.133" ± 0.002" | Poor | 4/13 High Order 9/13 Low Order-no dent |
| 6 | Milled DBX-1 11.71 μm | Unmilled DBX-1 12 mg 10 Kpsi 0.093 ± 0.002" | 12 mg 12 Kpsi 0.100" ± 0.002" | 0.01294" (Unsealed) | High Order |
| 7 | Milled DBX-1 11.71 μm | Unmilled DBX-1 12 mg 10 Kpsi 0.093 ± 0.002" | 12 mg 12 Kpsi 0.100" ± 0.002" | 0.01372" (Sealed) | High Order |

The results indicate that the lead-free milled DBX-1 in combination with unmilled DBX-1 and HMX performed under the same performance standards as the standard lead-based detonator composition containing LS and LA.

The weight and volume of the HMX output charge was less in the lead-free milled DBX-1 composition compared to the standard LS and LA based M100 composition. It may be expected that reducing the weight and column height of the loaded HMX output charge would reduce the output dent, however, it was unexpectedly discovered that increasing the loading volume of unmilled DBX-1 and lowering its consolidation pressure provides the same performance results under standard firing conditions of 1.6V at 100 μF capacitor (Test numbers 6-7).

While the invention has been described with reference to certain embodiments, changes, alterations and modifications to the described embodiments are possible without departing from the spirit and scope of the invention as defined in the appended claims, and equivalents thereof.

What is claimed is:

1. An electric detonator comprising:

a metal bridgewire having a spot charge composition disposed thereon wherein said spot charge composition comprises milled DBX-1;

an intermediate charge comprising unmilled DBX-1; and output charge.

2. The electric detonator of claim 1, wherein the particle size of the milled DBX-1 is about 1 μm to about 28 μm.

3. The electric detonator of claim 1, wherein the particle size of the milled DBX-1 is about 5 μm to about 1 μm.

4. The electric detonator of claim 1, wherein the spot charge composition further comprises nitrocellulose and lacquer.

5. The electric detonator of claim 1, wherein said spot charge composition is a slurry.

6. The spot charge composition of claim 1, wherein the milled DBX-1 is a single spot charge at about 0.27 mg to about 0.38 mg per header.

7. The electric detonator of claim 1, wherein the metal bridgewire is selected from the group consisting of nickel chrome, platinum, tungsten, and platinum-iridium.

8. The electric detonator of claim 1, wherein the bridgewire is nickel chrome.

9. The bridgewire of claim 8 wherein the diameter of said nickel chrome bridgewire is about 0.00023 inches.

10. The electric detonator of claim 1, wherein the unmilled DBX-1 is about 12 mg.

11. The electric detonator of claim 1, wherein the unmilled DBX-1 is loaded at a consolidation pressure of about 8 Kpsi to about 10 Kpsi and the height of the loaded unmilled DBX-1 is about 0.090 to about 0.060 inches.

12. The electric detonator of claim 1, wherein the output charge is HMX or CL-20.

13. The electric detonator of claim 1, wherein the output charge is HMX.

14. The electric detonator of claim 1, wherein the HMX is about 12 mg and loaded at a consolidation pressure of about 12 to about 14 Kpsi and about 0.100 inches to about 0.130 inches in height.

15. An electric detonator comprising:

a nickel chrome bridgewire having a spot charge composition disposed thereon and wherein said spot charge composition comprises milled DBX-1, nitrocellulose and lacquer and wherein said spot charge composition is a slurry;

an intermediate charge comprising unmilled DBX-1; and HMX.

* * * * *